US008104453B2

(12) United States Patent
Kobayashi

(10) Patent No.: US 8,104,453 B2
(45) Date of Patent: Jan. 31, 2012

(54) EVAPORATED FUEL TREATING APPARATUS AND METHOD OF TREATING EVAPORATED FUEL

(75) Inventor: Masahide Kobayashi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 328 days.

(21) Appl. No.: 12/522,082

(22) PCT Filed: Jan. 11, 2008

(86) PCT No.: PCT/JP2008/050251

§ 371 (c)(1),
(2), (4) Date: Jul. 2, 2009

(87) PCT Pub. No.: WO2008/099628

PCT Pub. Date: Aug. 21, 2008

(65) Prior Publication Data

US 2010/0012098 A1 Jan. 21, 2010

(30) Foreign Application Priority Data

Feb. 14, 2007 (JP) ..... 2007-033055

(51) Int. Cl.
*F02D 33/02* (2006.01)
*F02D 33/00* (2006.01)

(52) U.S. Cl. ..... 123/519

(58) Field of Classification Search ..... 123/519, 123/518, 516, 520, 198 D; 137/587, 588
See application file for complete search history.

(56) References Cited

U.S. PATENT DOCUMENTS

| | | | | |
|---|---|---|---|---|
| 4,598,741 | A * | 7/1986 | Johnson et al. | 141/5 |
| 4,886,096 | A * | 12/1989 | Reddy | 141/45 |
| 6,604,407 | B2 * | 8/2003 | Kano et al. | 73/49.7 |
| 2006/0016252 | A1 | 1/2006 | Iriyama | |

FOREIGN PATENT DOCUMENTS

| | | |
|---|---|---|
| DE | 43 16 728 A1 | 3/1994 |
| JP | A-5-340315 | 12/1993 |
| JP | A-07-109937 | 4/1995 |
| JP | A-7-253058 | 10/1995 |
| JP | A-2003-042014 | 2/2003 |
| JP | A-2003-214263 | 7/2003 |
| JP | A-2006-37783 | 2/2006 |
| JP | A-2007-16622 | 1/2007 |

OTHER PUBLICATIONS

Search Report issued in corresponding European Patent Application No. 08 70 3115.9, dated Sep. 6, 2010. Notice of Reasons for Rejection for Corresponding Japanese Patent Application No. 2007-033055, mailed on Oct. 19, 2010 (w/ English translation).
May 19, 2011 Office Action issued in Korean Patent Application No. 10-2009-7018497 (with English Translation).

* cited by examiner

*Primary Examiner* — Mahmoud Gimie
(74) *Attorney, Agent, or Firm* — Oliff & Berridge, PLC

(57) ABSTRACT

An evaporated fuel treating apparatus and method of treating evaporated fuel, that can re-gasify adsorbed fuel within a canister and supply it to an engine, are obtained. A compressor, a first control valve, a storage container and a second control valve are provided at a supply delivery piping that communicates a canister with an engine air intake tube, in that order from the canister side. By driving the compressor, vapor within the canister is fed to the storage container, canister internal pressure is lowered, and gasification of a fuel component adsorbed by an adsorbent is promoted. Further, evaporated fuel stored in the storage container is forcibly fed to an engine by internal pressure of the storage container.

12 Claims, 2 Drawing Sheets

EVAPORATED FUEL TREATING APPARATUS AND METHOD OF TREATING EVAPORATED FUEL

TECHNICAL FIELD

The present invention relates to an evaporated fuel treating apparatus and a method of treating evaporated fuel.

BACKGROUND TECHNOLOGY

As an evaporated fuel treating apparatus for treating evaporated fuel generated at a fuel tank or the like, Patent Document 1 discloses a structure that, by using a suction pump for pressure reduction of a vacuum boosting device for the brake, guides the exhaust of this suction pump to a canister, and re-gasifies the fuel adsorbed at the canister. Due thereto, evaporated fuel, that is adsorbed at a canister, can be re-gasified by a simple structure.

By the way, in a structure that carries out gasification of adsorbed fuel within a canister by the exhaust of a suction pump in this way, there are cases in which time is required when feeding the evaporated fuel, that is re-gasified at the canister, to the engine. In actual evaporated fuel treating apparatuses and methods of treating evaporated fuel, it is desired to re-gasify adsorbed fuel within a canister and supply it to the engine in a shorter time period.

Patent Document 1: Japanese Patent Application Laid-Open (JP-A) No. 7-253058

DISCLOSURE OF THE INVENTION

Problems to be Solved by the Invention

In view of the above-described circumstances, the topic of the present invention is to obtain an evaporated fuel treating apparatus and method of treating evaporated fuel that can re-gasify adsorbed fuel within a canister and supply it to an engine in a shorter time period.

Means for Solving the Problems

Exemplary embodiments include: a canister that communicates with a fuel tank, and into which evaporated fuel that is generated within the fuel tank is introduced; a blocking valve provided at an atmosphere communicating tube that communicates the canister with the atmosphere, and able to shut-off communication of the canister with the atmosphere; a canister internal pressure sensor detecting an internal pressure of the canister; a pressure reducing device able to reduce pressure of a canister interior; and storing means provided at a fuel supply tube that communicates the pressure reducing device and an engine, and able to temporarily store evaporated fuel.

In exemplary embodiments, the storing means is structured by: a storage container installed at the fuel supply tube; a first control valve installed at the fuel supply tube between the pressure reducing device and the storage container; and a second control valve installed at the fuel supply tube between the storage container and the engine.

Exemplary embodiments include a method of treating evaporated fuel that treats evaporated fuel by using the evaporated fuel treating apparatus. The method includes: a storing step of reducing pressure of the canister interior to a predetermined pressure by the pressure reducing device in a state in which the blocking valve is closed, and storing, in the storing means, evaporated fuel that is gasified; and a supplying step of supplying the evaporated fuel, that is stored in the storing means, through the fuel supply tube to the engine.

In exemplary embodiments, evaporated fuel can be treated by, for example, the method of treating evaporated fuel.

Namely, in the storing step, first, the blocking valve is closed, and communication of the canister with the atmosphere is obstructed. The pressure reducing device is driven in this state, and, while the canister internal pressure is detected by the canister internal pressure sensor, the pressure of the canister interior is reduced to the predetermined pressure. Due thereto, the evaporated fuel that is adsorbed by the adsorbent within the canister is re-gasified and is stored in the storing means.

Next, in the supplying step (e.g., at the time of engine driving), the evaporated fuel stored in the storing means is supplied to the engine through the fuel supply tube. Because gasified fuel is stored in advance in the storing means, gasified fuel can be supplied to the engine in a short time period.

In exemplary embodiments, in the storing step, the blocking valve is opened during reducing of pressure of the canister interior.

In this way, by opening the blocking valve during reducing of pressure of the canister interior and introducing the atmosphere into the canister, the evaporated fuel that is gasified can be controlled so as to be re-adsorbed by the adsorbent within the canister.

In exemplary embodiments in the storing step, after the canister interior becomes the predetermined pressure due to pressure reduction by the pressure reducing device, pressure of the canister interior is further reduced by the pressure reducing device.

In this way, after the canister interior becomes the predetermined pressure, by further reducing the pressure of the canister interior by the pressure reducing device, the fuel component that remains and is adsorbed by the adsorbent within the canister can be desorbed.

In exemplary embodiments, in the storing step, the pressure reducing device is driven in a state in which the first control valve is opened and the second control valve is closed.

In exemplary embodiments, in the supplying step, the first control valve is closed, the second control valve is opened, and the evaporated fuel stored in the storage container is supplied to the engine.

In exemplary embodiments, treating of evaporated fuel can be carried out by the method of treating evaporated or the method of treating evaporated fuel.

In the method of treating evaporated fuel of exemplary embodiments, because the first control valve is opened and the second control valve is closed, the evaporated fuel within the canister can be fed to the storage container by driving of the pressure reducing device.

In the method of treating evaporated fuel in exemplary embodiments, because the first control valve is closed and the second control valve is opened, the evaporated fuel stored in the storage container can be fed to the engine through the fuel supply tube.

Effects of the Invention

Because the present invention is structured as described above, it is possible to re-gasify adsorbed fuel within a canister and supply it to an engine in a shorter time period.

PREFERRED FORMS FOR EMBODYING THE INVENTION

Figure 1:
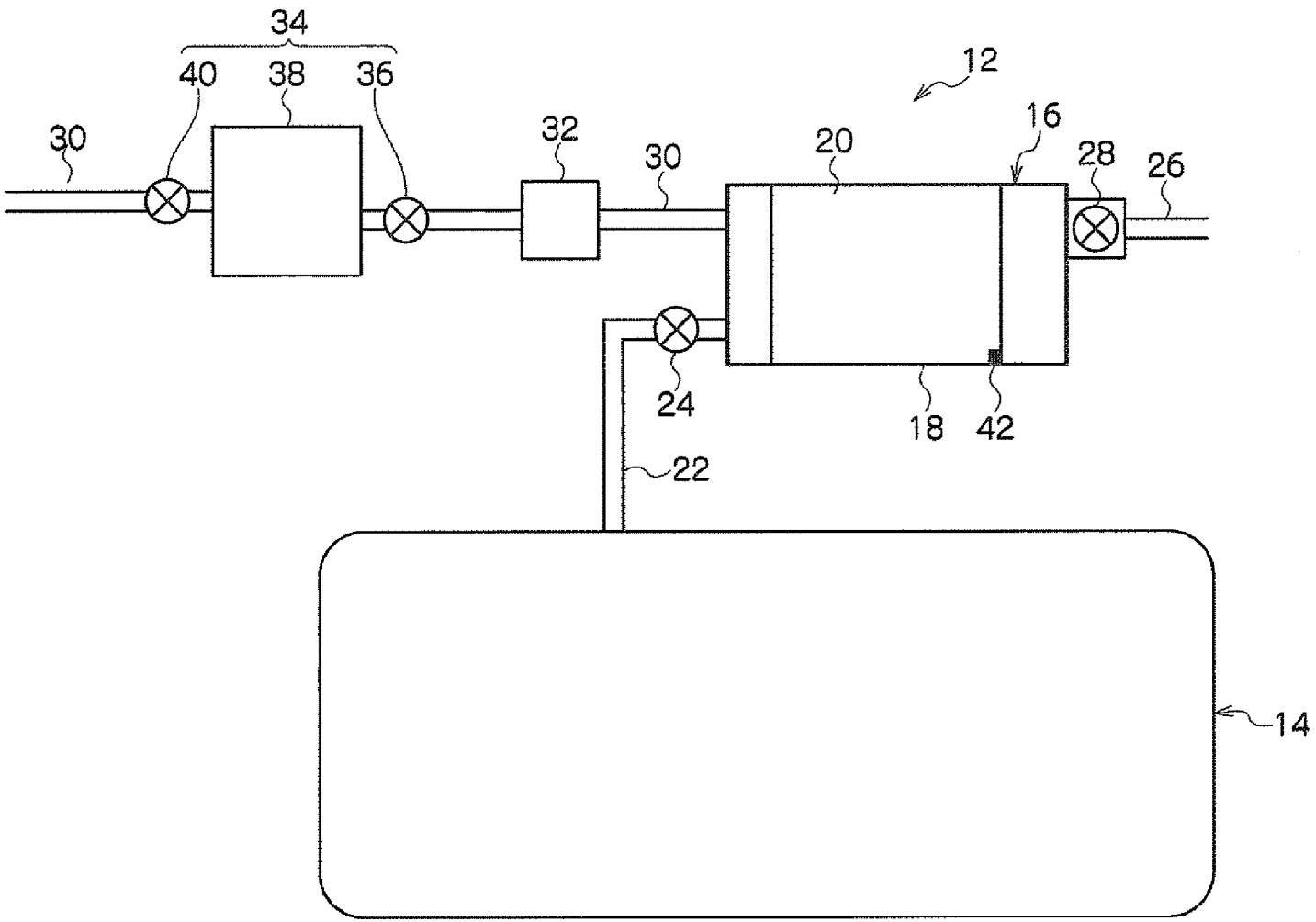
FIG. 1 is a schematic structural drawing showing an evaporated fuel treating apparatus of an embodiment of the present invention.

An evaporated fuel treating apparatus 12 of an embodiment of the present invention is shown in FIG. 1. This evaporated fuel treating apparatus 12 is used in order to treat, in a canister 16, evaporated fuel that is generated at a fuel tank 14 or the like that is installed in an automobile. An adsorbent 20 that is structured so as to include activated carbon is accommodated within a canister container 18 that structures the canister 16, and evaporated fuel can be adsorbed and desorbed by this absorbent 20.

Note that, in the present embodiment, the object of application is a so-called hybrid car that, in addition to an engine, is equipped with a motor for driving (both of which are not illustrated) that receives supply of electric power from a battery for traveling as the driving sources for vehicle traveling.

The fuel tank 14 and the canister 16 are connected by a vapor piping 22. An open/close valve 24 is provided at the vapor piping 22, and the movement of evaporated fuel from the fuel tank 14 to the canister 16 can be controlled.

An atmosphere communicating tube 26, that communicates with the exterior (the atmosphere) is provided at the canister 16, and a blocking valve 28 is provided at the atmosphere communicating tube 26. The internal pressure of the canister 16 (canister internal pressure) can be maintained at a desired pressure by opening/closing, or adjusting the degree of opening, of the open/close valve 24 and the blocking valve 28, respectively. Therefore, the canister container 18 is structured to have pressure-resistance such that it can withstand the canister internal pressure that is supposed.

Further, a supply delivery piping 30 is provided between the canister 16 and an unillustrated engine air intake tube. A compressor 32, a first control valve 36, a storage container 38 and a second control valve 40 are provided at the supply delivery piping 30 in that order from the canister 16 side. A storing means 34 of the present invention is structured by the first control valve 36, the storage container 38 and the second control valve 40.

By driving, the compressor 32 sucks the vapor within the canister 16, and can feed it to the storage means 34 (the storage container 38). In particular, by driving the compressor 32 in the state in which the blocking valve 28 is closed, the pressure within the canister 16 is reduced. Further, by driving the compressor 32 in the state in which the first control valve 36 is open and the second control valve 40 is closed, the vapor that is sucked from the canister 16 can be stored in the storage container 38. Note that internal pressure acts on the storage container 38 due to the stored vapor, but the storage container 38 has pressure-resistance such that it can withstand the maximum internal pressure that is supposed.

Figure 2:
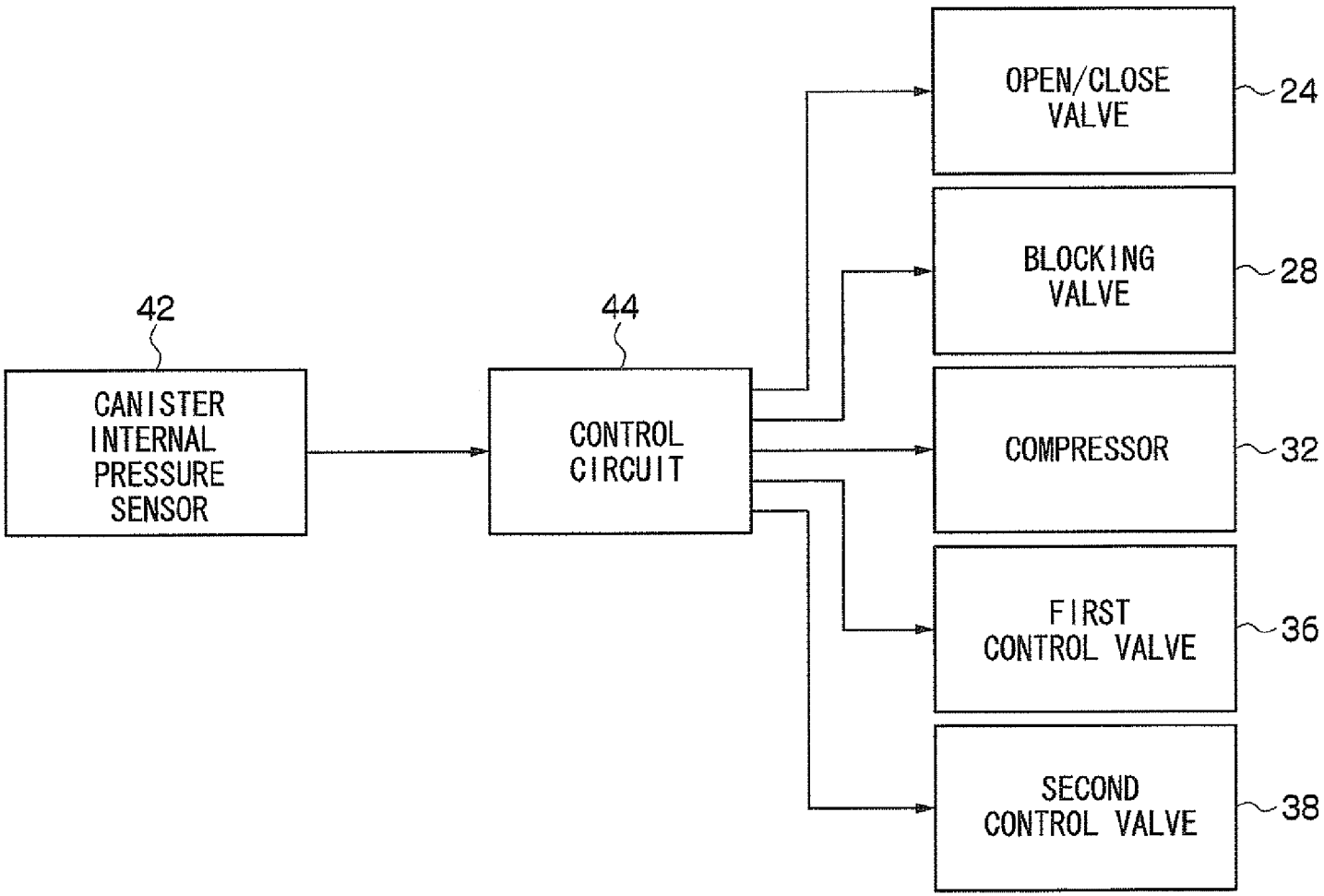
FIG. 2 is a block diagram of the evaporated fuel treating apparatus of the embodiment of the present invention.

Within the canister 16 is provided a canister internal pressure sensor 42 that detects the internal pressure thereof. As shown in FIG. 2, the canister internal pressure sensor 42 sends the detected internal pressure data to a control circuit 44. Further, the opening/closing and the adjustment of the degree of opening of the open/close valve 24, the blocking valve 28, the first control valve 36 and the second control valve 40 are carried out by the control circuit 44 by, for example, duty control. Similarly, the compressor 32 as well is driven-controlled by the control circuit 44.

Next, the operation and effects of the evaporated fuel treating apparatus 12 of the present embodiment will be described.

In the evaporated fuel treating apparatus 12 of the present embodiment, in the same way as a general evaporated fuel treating apparatus, by opening the open/close valve 24, the evaporated fuel generated within the fuel tank 14 is fed into the canister 16 and can be adsorbed by the adsorbent 20.

Here, in the evaporated fuel treating apparatus 12 of the present embodiment in particular, in the state in which evaporated fuel is adsorbed by the adsorbent 20 within the canister 16, the blocking valve 28 is closed and the compressor 32 is driven. At this time, the first control valve 36 is opened, and the second control valve 40 is closed. Due thereto, vapor within the canister 16 is fed to the storage container 38, and the canister internal pressure decreases. Further, the compressor 32 is driven-controlled until the canister internal pressure becomes a set value that is set in advance (e.g., around 50 kPa as absolute pressure) by the canister internal pressure sensor 42.

Generally, the fuel component that is adsorbed by the adsorbent 20 within the canister 16 has vapor pressure of vapor pressure (approximately 50 kPa as absolute pressure) that is less than or equal to the vapor pressure of gasoline at around 40° C. Accordingly, by making the canister internal pressure be around 50 kPa as described above, the fuel component that is adsorbed by the adsorbent 20 can be brought to a boiling state or a state that is near thereto, and gasification, i.e., desorption, can be promoted Here, if the change in the canister internal pressure detected by the canister internal pressure sensor 42 is stable, it can be judged that the gasification of the fuel component adsorbed by the adsorbent 20 is finished, and therefore, driving of the compressor 32 is stopped. Note that, in the state in which the change in the canister internal pressure is stable in this way, the compressor 32 may be driven further and the canister internal pressure may be lowered. Due thereto, of the liquefied fuel that remains within the canister 16, in particular, the low-boiling point component thereof can be gasified and desorbed. The fuel component that is gasified here is also fed to the storage container 38.

In this way, if the blocking valve 28 is opened while the canister internal pressure is maintained substantially constant, air flows-in into the canister 16 from the atmosphere communicating tube 26. Therefore, the evaporated fuel that gasified within the canister 16 is further fed to the storage container 38 by the flow of this air. Namely, by opening the blocking valve 28, the evaporated fuel that gasified within the canister 16 can be purged while being prevented from being adsorbed again by the adsorbent 20.

Due to the above-described process, by moving vapor (evaporated fuel) from the canister 16 to the storage container 38 and temporarily storing it, evaporated fuel of a uniform concentration can be accommodated within the storage container 38. Further, the pressure within the storage container 38 becomes high.

Here, for example, at the time of engine driving or the like, if the first control valve 36 is closed and further the second control valve 40 is opened, the evaporated fuel within the storage container 38 is fed to the engine through the supply delivery piping 30 and the engine supply tube by the internal pressure of the storage container 38. Namely, even in cases in which the negative pressure generated at the engine is small, the evaporated fuel can be forcibly fed to the engine by the internal pressure of the storage container 38. In particular, in a hybrid car or the like that is the object of application of the present embodiment, the operating time of the engine is often short, but, even in these cases, evaporated fuel can be reliably fed to the engine.

Further, because the concentration of the evaporated fuel within the storage container 38 is made to be uniform, fluctuations in the so-called A/F (the ratio of air to fuel) at the time of supplying evaporated fuel to the engine are small as compared with a structure in which evaporated fuel is not stored temporarily in such a storage container 38. Due thereto, driving of the engine at the time of purging can be stabilized, and control of emissions can be carried out easily.

Note that, in the above description, the compressor is given as an example of the pressure reducing device of the present invention, but it suffices to be able to reduce the pressure within the canister, and, for example, a pump may be used.

DESCRIPTION OF THE REFERENCE NUMERALS

12 evaporated fuel treating apparatus
14 fuel tank
16 canister
18 canister container
20 adsorbent
22 vapor piping
24 open/close valve
26 atmosphere communicating tube
28 blocking valve
30 fuel delivery piping
32 compressor (pressure reducing device)
34 storing means
36 first control valve
38 storage container
40 second control valve
42 canister internal pressure sensor
44 control circuit

The invention claimed is:

1. An evaporated fuel treating apparatus comprising:
a canister that communicates with a fuel tank, and into which evaporated fuel that is generated within the fuel tank is introduced;
a blocking valve provided at an atmosphere communicating tube that communicates the canister with the atmosphere, and is able to shut-off communication of the canister with the atmosphere;
a canister internal pressure sensor that detects an internal pressure of the canister, the canister internal pressure sensor being disposed within the canister;
a pressure reducing device able to reduce pressure of a canister interior; and
storing means provided at a fuel supply tube that communicates the pressure reducing device and an engine, and able to temporarily store evaporated fuel.

2. The evaporated fuel treating apparatus of claim 1, wherein the storing means is structured by:
a storage container installed at the fuel supply tube;
a first control valve installed at the fuel supply tube between the pressure reducing device and the storage container; and
a second control valve installed at the fuel supply tube between the storage container and the engine.

3. A method of treating evaporated fuel by using an evaporated fuel treating apparatus comprising:
a canister that communicates with a fuel tank, and into which evaporated fuel that is generated within the fuel tank is introduced;
a blocking valve provided at an atmosphere communicating tube that communicates the canister with the atmosphere, and able to shut-off communication of the canister with the atmosphere;
a canister internal pressure sensor detecting an internal pressure of the canister, the canister internal pressure sensor being disposed within the canister;
a pressure reducing device able to reduce pressure of a canister interior; and
storing means provided at a fuel supply tube that communicates the pressure reducing device and an engine, and able to temporarily store evaporated fuel,
the method comprising:
a storing step of reducing pressure of the canister interior to a predetermined pressure by the pressure reducing device in a state in which the blocking valve is closed, and storing, in the storing means, evaporated fuel that is gasified; and
a supplying step of supplying the evaporated fuel, that is stored in the storing means, through the fuel supply tube to the engine.

4. The method of treating evaporated fuel of claim 3, wherein, in the storing step, the blocking valve is opened during reducing of pressure of the canister interior.

5. The method of treating evaporated fuel of claim 3, wherein, in the storing step, after the canister interior becomes the predetermined pressure due to pressure reduction by the pressure reducing device, pressure of the canister interior is further reduced by the pressure reducing device.

6. The method of treating evaporated fuel of claim 3, wherein the storing means is structured by:
a storage container installed at the fuel supply tube;
a first control valve installed at the fuel supply tube between the pressure reducing device and the storage container; and
a second control valve installed at the fuel supply tube between the storage container and the engine,
wherein, in the supplying step, the first control valve is closed, the second control valve is opened, and the evaporated fuel stored in the storage container is supplied to the engine.

7. The method of treating evaporated fuel of claim 4, wherein, in the storing step, after the canister interior becomes the predetermined pressure due to pressure reduction by the pressure reducing device, pressure of the canister interior is further reduced by the pressure reducing device.

8. The method of treating evaporated fuel of claim 3, wherein the storing means is structured by:
a storage container installed at the fuel supply tube;
a first control valve installed at the fuel supply tube between the pressure reducing device and the storage container; and
a second control valve installed at the fuel supply tube between the storage container and the engine, wherein,
wherein, in the storing step, the pressure reducing device is driven in a state in which the first control valve is opened and the second control valve is closed.

9. A method of treating evaporated fuel by using an evaporated fuel treating apparatus comprising:
a canister that communicates with a fuel tank, and into which evaporated fuel that is generated within the fuel tank is introduced;
a blocking valve provided at an atmosphere communicating tube that communicates the canister with the atmosphere, and able to shut-off communication of the canister with the atmosphere;
a canister internal pressure sensor detecting an internal pressure of the canister, the canister internal pressure sensor being disposed within the canister;
a pressure reducing device able to reduce pressure of a canister interior; and storing means provided at a fuel supply tube that communicates the pressure reducing device and an engine, and able to temporarily store evaporated fuel, wherein the storing means is structured by:

a storage container installed at the fuel supply tube;

a first control valve installed at the fuel supply tube between the pressure reducing device and the storage container; and a second control valve installed at the fuel supply tube between the storage container and the engine, the method comprising:

a storing step of reducing pressure of the canister interior to a predetermined pressure by the pressure reducing device in a state in which the blocking valve is closed, and storing, in the storing means, evaporated fuel that is gasified; and a supplying step of supplying the evaporated fuel, that is stored in the storing means, through the fuel supply tube to the engine.

10. The method of treating evaporated fuel of claim 9, wherein, in the storing step, the blocking valve is opened during reducing of pressure of the canister interior.

11. The method of treating evaporated fuel of claim 9, wherein, in the storing step, after the canister interior becomes the predetermined pressure due to pressure reduction by the pressure reducing device, pressure of the canister interior is further reduced by the pressure reducing device.

12. The method of treating evaporated fuel of claim 10, wherein, in the storing step, after the canister interior becomes the predetermined pressure due to pressure reduction by the pressure reducing device, pressure of the canister interior is further reduced by the pressure reducing device.

* * * * *